US005975991A

United States Patent [19]

Karlsrud

[11] Patent Number: 5,975,991

[45] Date of Patent: Nov. 2, 1999

[54] METHOD AND APPARATUS FOR PROCESSING WORKPIECES WITH MULTIPLE POLISHING ELEMENTS

[75] Inventor: Chris Karlsrud, Chandler, Ariz.

[73] Assignee: Speedfam-Ipec Corporation, Chandler, Ariz.

[21] Appl. No.: 08/978,809

[22] Filed: Nov. 26, 1997

[51] Int. Cl.[6] ..... B24B 1/00

[52] U.S. Cl. ..... 451/41; 451/287

[58] Field of Search ..... 451/41, 287, 288, 451/65, 461

[56] References Cited

U.S. PATENT DOCUMENTS 4,481,741 11/1984 Bouladon et al. ..... 51/131.1

5,435,772 7/1995 Yu ..... 451/63

5,554,065 9/1996 Clover .

*Primary Examiner*—David A. Scherbel

*Assistant Examiner*—Dung Van Nguyen

*Attorney, Agent, or Firm*—Snell & Wilmer

[57] ABSTRACT

A chemical mechanical planarization (CMP) system includes multiple workpiece processing elements arranged in a vertically staggered configuration. The polishing elements are positioned such that an outer edge of a first polishing element overlaps the inner edge of a second polishing element. The overlapping arrangement enables the CMP system to utilize additional polishing elements without substantially increasing the footprint of the CMP system. Each of the polishing elements exhibit different polishing characteristics to enable multiple-step workpiece processing.

33 Claims, 4 Drawing Sheets

METHOD AND APPARATUS FOR PROCESSING WORKPIECES WITH MULTIPLE POLISHING ELEMENTS

TECHNICAL FIELD

The present invention relates generally to chemical mechanical planarization (CMP) systems that are utilized during the manufacture of workpieces such as semiconductor wafers. More particularly, the present invention relates to a CMP system that employs multiple polishing elements mounted to a single platen in a physically compact manner.

BACKGROUND OF THE INVENTION

The production of integrated circuits begins with the creation of high-quality semiconductor wafers. During the wafer fabrication process, the wafers may undergo multiple masking, etching, and dielectric and conductor deposition processes. Because of the high precision required in the production of these integrated circuits, an extremely flat surface is generally needed on at least one side of the semiconductor wafer to ensure proper accuracy and performance of the microelectronic structures being created on the wafer surface. As the size of integrated circuits continues to decrease and the number of microstructures per integrated circuit increases, the need for precise wafer surfaces becomes more important. Therefore, between each processing step, it is usually necessary to polish or planarize the surface of the wafer to obtain the flattest surface possible.

For a discussion of chemical mechanical planarization (CMP) processes and apparatus, see, for example, Arai, et al., U.S. Pat. No. 4,805,348, issued February, 1989; Arai, et al., U.S. Pat. No. 5,099,614, issued March, 1992; Karlsrud, et al., U.S. Pat. No. 5,329,732, issued July, 1994; Karlsrud et al., U.S. Pat. No. 5,498,196, issued March, 1996; and Karlsrud, et al., U.S. Pat. No. 5,498,199, issued March, 1996.

Such polishing is well known in the art and generally includes attaching one side of the wafer to a flat surface of a wafer carrier or chuck and pressing the other side of the wafer against a flat polishing surface. In general, the polishing surface includes a polishing pad that has an exposed abrasive surface of, for example, cerium oxide, aluminum oxide, fumed/precipitated silica or other particulate abrasives. During the polishing or planarization process, the workpiece or wafer is typically pressed against the polishing pad surface while the pad rotates about its vertical axis. In addition, to improve the polishing effectiveness, the wafer may also be rotated about its vertical axis and oscillated back and forth over the surface of the polishing pad.

Many semiconductor workpieces require multiple polishing steps, e.g., an aggressive material removal step followed by one or more buffing or final polishing steps. Due to the different layers that may be present in the workpiece and the different goals of the various processing steps, a number of different polishing pads and/or polishing slurries may be utilized during a CMP procedure. Consequently, many conventional CMP systems utilize a number of distinct polishing pads, each respectively mounted to a separate rotatable polishing table. To accommodate a plurality of polishing tables, such CMP systems often require an undesirably large operating area. Unfortunately, many semiconductor manufacturing facilities lack the large amount of free floor space required for large CMP machines. In addition, the footprint of such machines should be kept to a minimum because floor space is expensive within the clean room environment.

The need for compact CMP machines may increase with the demand for large semiconductor wafers (e.g., twelve inches in diameter or larger). To achieve effective planarization and polishing of twelve-inch wafers, the CMP polishing pads should be appropriately sized. Accordingly, any footprint restrictions will become increasingly difficult to meet with a CMP machine that utilizes a plurality of unstacked and distinct polishing pads.

Clover, U. S. Pat. No. 5,554,065, issued Sept. 10, 1996, discloses a vertically stacked planarization machine that is intended to provide a physically compact system capable of processing semiconductor wafers. Unfortunately, this machine requires a complex control system that employs an elevator assembly and an intricate cam mechanism for rotating the stacked polishing pads. Thus, while the vertically stacked arrangement may conserve some space otherwise reserved for polishing pads arranged in a horizontal configuration, vertical and horizontal space is sacrificed to accommodate the elevator assembly, control elements, and rotating mechanism. Furthermore, the use of many individual polishing pads to accommodate a higher throughput may yield undesirably nonuniform results from wafer to wafer, and the complex control system may not otherwise function in a sufficiently robust and consistent manner.

The prior art lacks a practical space-saving solution for existing CMP systems that utilize a plurality of horizontally disposed polishing pads. High quality CMP systems can cost millions of dollars; it may not be economical to replace an existing system with an entirely new system or to retrofit an existing system with complicated hardware upgrades. It may also be uneconomical to modify an existing CMP machine to accommodate one or more additional polishing pads without increasing the footprint of the machine.

SUMMARY OF THE INVENTION

Accordingly, it is an advantage of the present invention that an improved CMP system is provided.

Another advantage of the present invention is that an improved CMP machine may include an increased number of polishing elements without substantially increasing the dimensions of the machine.

Another advantage is that the present invention provides a CMP machine having an increased number of polishing elements, each of which is capable of uniformly processing a number of workpieces in a simultaneous manner.

A further advantage of the present invention is that it provides an increased number of polishing elements that function in a relatively conventional manner without complex control mechanisms.

An additional advantage is that the present invention may be utilized to retrofit conventional CMP machines in an economical manner without extensive modifications to existing hardware and software.

The above and other advantages of the present invention may be carried out in one form by a CMP system having a carrier element configured to hold a workpiece during processing, a first polishing element configured to rotate about an axis of rotation, and a second polishing element physically distinct from the first polishing element and configured to rotate about the same axis of rotation. The second polishing element has different polishing characteristics than the first polishing element, the first polishing element is configured to perform initial processing of the workpiece when the carrier element holds the workpiece in contact with the first polishing element, and the second polishing element is configured to perform subsequent processing of the workpiece when the carrier element holds the workpiece in contact with the second polishing element.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF A PREFERRED EXEMPLARY EMBODIMENT

Figure 1:
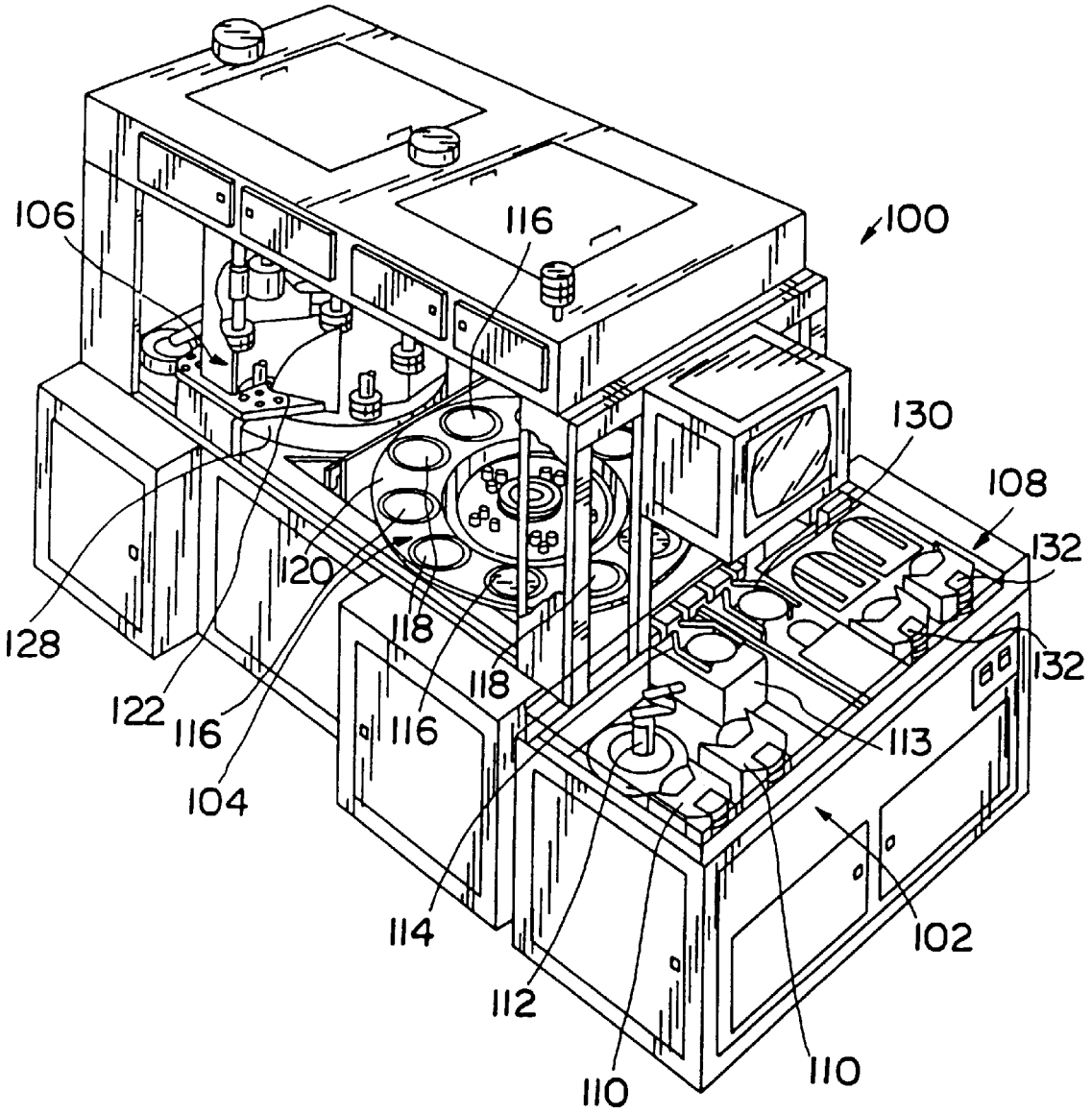
FIG. 1 is a perspective view of an exemplary CMP machine in accordance with the present invention.
Figure 2:
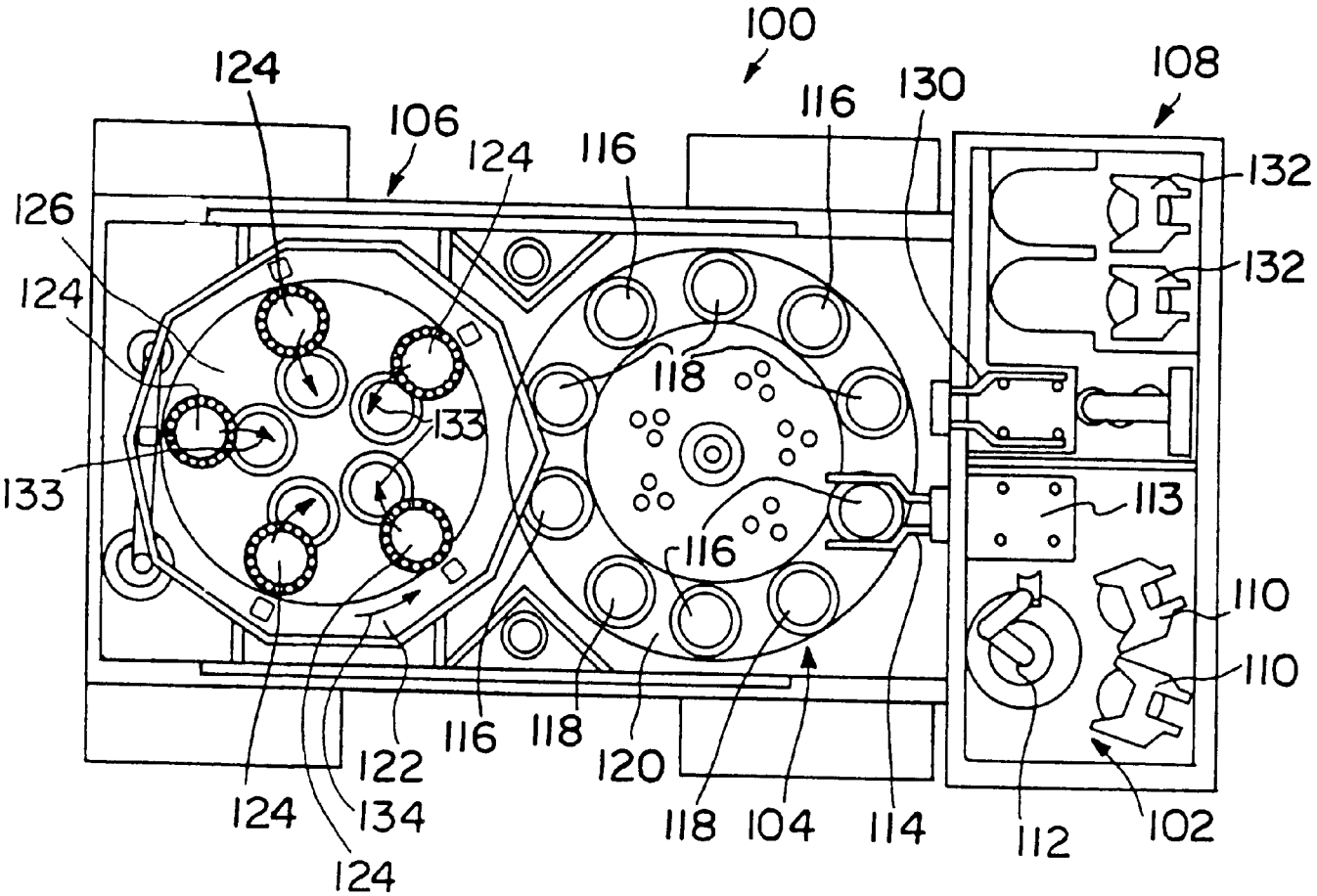
FIG. 2 is a top view of the CMP machine of FIG. 1.

Referring now to FIGS. 1–2, a workpiece polishing apparatus 100 is shown embodying the present invention. Workpiece polishing apparatus 100 is suitably configured as a multiple head polishing machine that accepts semiconductor wafers from a previous processing step, polishes and rinses the wafers, and reloads the wafers back into wafer cassettes for subsequent processing. It should be noted that, although the present invention is described herein in the context of semiconductor wafer polishing, any suitable workpieces may be processed by workpiece polishing apparatus 100.

Polishing apparatus 100 generally includes a load station 102, a transition station 104, a polishing station 106, and a rinse and unload station 108. Discussing polishing apparatus 100 in more detail, a number of cassettes 110, each holding a plurality of wafers, are preferably loaded into polishing apparatus 100 at load station 102. Next, a robotic carrier arm 112 removes the wafers from cassettes 110 and places them, one at a time, on a hand off fixture 113. A first transfer arm 114 then sequentially lifts and moves each wafer from hand off fixture 113 into transition section 104. That is, transfer arm 114 suitably places an individual wafer on one of a plurality of pick-up stations 116 which reside on a rotatable index table 120 within transition section 104. Rotatable index table 120 also suitably includes a plurality of drop-off stations 118 which alternate with pick-up stations 116. After a wafer is deposited on one of the plurality of pick-up stations 116, index table 120 rotates so that a new pick-up station 116 is aligned with transfer arm 114. Transfer arm 114 then places the next wafer on the new empty pick-up station 116. This process continues until all pick-up stations 116 are filled with wafers. In the illustrated embodiment of the invention, index table 120 includes five pick-up stations 116 and five drop-off stations 118.

Next, a carrier assembly 122, which includes a plurality of individual carrier elements 124, suitably aligns itself over index table 120 so that respective carrier elements 124 are positioned directly above the wafers which reside in respective pick-up stations 116. Pick-up stations 116 then move up to place the wafers into carrier elements 124. Next, carrier assembly 122 moves the wafers laterally such that the wafers are positioned above polishing station 106. Once above polishing station 106, carrier assembly 122 suitably lowers the wafers, which are held by individual carrier elements 124, into operative engagement with a first polishing pad 126 which sits upon a rotatable platen 128. During operation, rotatable platen 128 causes first polishing pad 126 to rotate about its vertical axis. At the same time, individual carrier elements 124 may spin the wafers about their respective vertical axes and oscillate the wafers back and forth across first polishing pad 126 (substantially along arrow 133) as they press against first polishing pad 126. In this manner, the undersurface of the wafer is polished or planarized.

Figure 3:
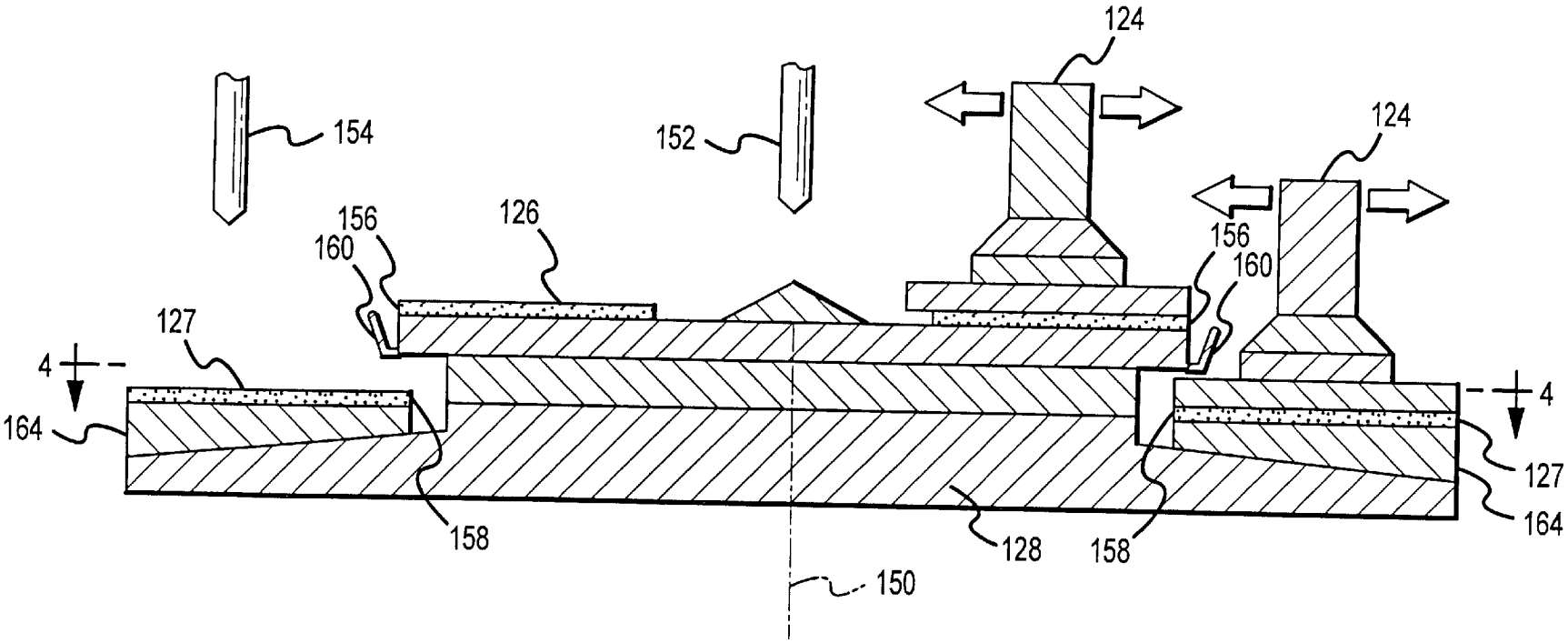
FIG. 3 is a side sectional view of an exemplary dual-element polishing table configured in accordance with the present invention.

In the preferred embodiment, a second polishing pad 127 having different polishing characteristics than first polishing pad 126 is mounted to rotatable platen 128 in a vertically staggered position, relative to first polishing pad 126 (see FIG. 3). For the sake of clarity, second polishing pad 127, which is partially located underneath first polishing pad 126, is not shown in FIGS. 1–2. As described in more detail below, carrier assembly 122 may manipulate carrier elements 124 such that the wafers are subsequently polished by second polishing pad 127. Second polishing pad 127 may be desirable for multiple-step processing of certain semiconductor wafers. Although not shown, polishing apparatus 100 may include any number of additional polishing pads as necessary for the particular application.

Although polishing apparatus 100 is shown having five carrier elements 124, it will be appreciated that it may employ virtually any number of carrier elements 124. Moreover, the present invention may also be employed in circumstances where not all of the carrier elements 124 are functioning at the same time. For example, many standard wafer cassettes are capable of carrying up to twenty-five individual workpieces in a single cassette. Consequently, because there are often five carrier elements 124 on a single CMP machine, often times less than five workpieces remaining within a cassette are polished at one time, leaving one or more carrier elements 124 empty.

With continued reference to FIG. 2, in a preferred embodiment of the present invention, each respective carrier element 124 suitably oscillates back and forth along arrow 133; each carrier element 124 also suitably rotates a workpiece about its vertical axis. At the same time, rotatable platen 128 and polishing pads 126, 127 are advantageously configured to rotate about their vertical axes, for example, in a counter clockwise direction as indicated by arrow 134.

After an appropriate polishing interval, carrier assembly 122 transports the wafers back to transition station 104. Drop-off stations 118 move up to carrier elements 124, and the wafers are ejected into drop-off stations 118 via an air and/or water blow off mechanism. After the wafers are ejected, the respective drop-off stations 118 move back down. The wafers are then removed from drop-off stations 118 by a second transfer arm 130. Second transfer arm 130 suitably lifts each wafer out of transition station 104 and transfers them into rinse and unload station 108. After a thorough rinsing, the wafers are reloaded into a number of cassettes 132, which may be used to transport the wafers to additional stations (not shown) for further processing or packaging. It should be noted that an additional processing step, such as further polishing, may occur at transition station 104. For example, an additional processing table may be incorporated into the CMP machine near index table 120.

Figure 4:
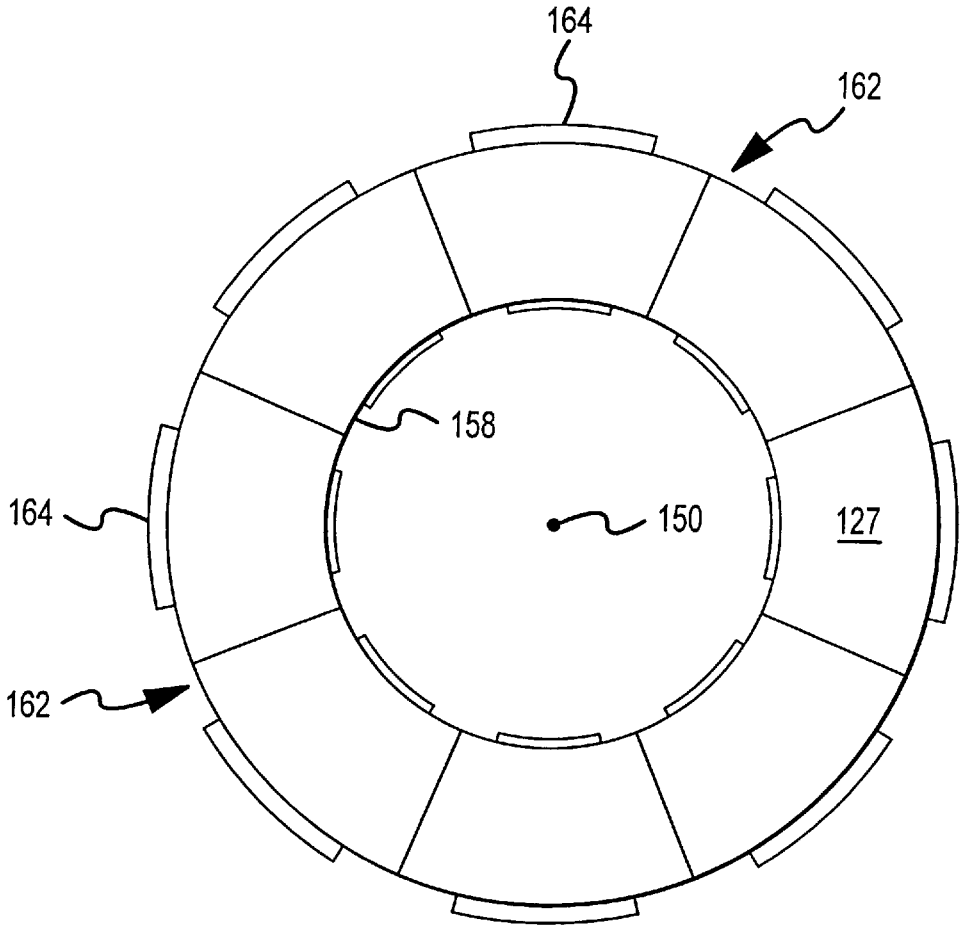
FIG. 4 is a top view of the polishing table shown in FIG. 3, as viewed from line 4—4.
Figure 5:
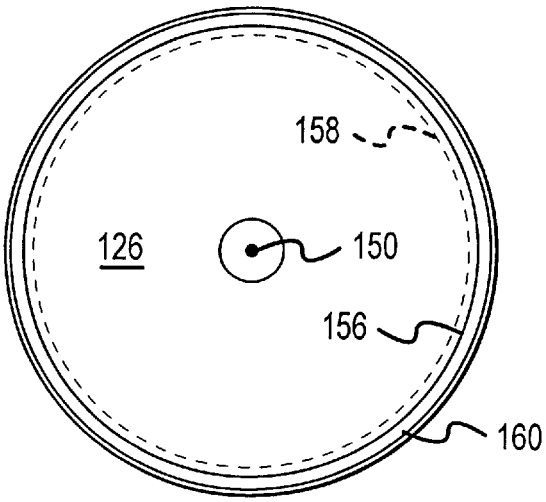
FIG. 5 is a top view of the upper polishing element shown in FIG. 3.

Referring now to FIGS. 3–5, a vertically staggered arrangement for first and second polishing elements 126, 127 will be described in detail. In this preferred arrangement, first and second polishing elements 126, 127 are physically distinct from one another. An alternate embodiment may utilize a single polishing element having a plurality of polishing zones that exhibit different polishing characteristics. Such an embodiment may be employed where a single slurry is applied to facilitate two polishing steps using different polishing pad compositions. Although the present invention may be configured such that first and second polishing elements 126, 127 are substantially coplanar, rotatable platen 128 is preferably configured such that the polishing plane defined by first polishing element 126 resides above the polishing plane defined by second polishing element 127 and such that first polishing element 126 overlaps second polishing element 127 in a manner that conserves the floor space associated with polishing apparatus 100. In other words, the surface area utilized for polishing may be increased without a substantial increase in the outer diameter of rotatable platen 128.

When in a polishing mode, carrier elements 124 are located proximate rotatable platen 128 to enable manipulation of the wafers into and out of contact with first and second polishing elements 126, 127. In the preferred embodiment, first and second polishing elements 126, 127 are both mounted to rotatable platen 128 such that movement of rotatable platen 128 causes simultaneous movement of first and second polishing elements 126, 127. However, in an alternate embodiment, first and second polishing elements 126, 127 may be mounted to separate rotatable platens having independently controllable polishing speeds and timing recipes. In such an embodiment, first and second polishing elements 126, 127 may be capable of rotating at different speeds and may be capable of independent movement relative to each other.

As best shown in FIGS. 4–5, first and second polishing elements 126, 127 may each be ring-shaped and mounted to rotatable platen 128 such that they are substantially concentric about a common axis of rotation 150. Such a configuration enables the dual-element platen 128 to be easily installed in existing CMP machines that utilize a single-element platen. It should be appreciated that each of the polishing elements 126, 127 may be realized as a one-piece construction (as shown in FIG. 5) or as a segmented construction (as shown in FIG. 4). The segmented construction may facilitate a uniformly flat installation of second polishing element 127 onto rotatable platen 128 and may enable the use of commercially available polishing materials that are commonly manufactured in smaller sizes.

First polishing element 126 is configured to process a workpiece when the respective carrier element 124 holds the workpiece in contact with the first polishing element 126. Similarly, second polishing element 127 is configured to further process the workpiece when the respective carrier element 124 holds the workpiece in contact with the second polishing element 127. In an alternate embodiment, first and second polishing elements may be simultaneously active, i.e., a first number of carrier elements 124 may process wafers on first polishing element 126 while a second number of carrier elements 124 simultaneously process different wafers on second polishing element 127. Such processing requires little, if any, modifications to existing CMP machines that utilize a carrier head assembly having independently controllable carrier elements 124.

In accordance with a preferred aspect of the present invention, second polishing element 127 has different polishing characteristics than first polishing element 126. For example, the abrasiveness and/or hardness of the polishing elements may vary to facilitate multiple stage material removal from a semiconductor wafer. In addition, the composition of the polishing elements may vary according to the specific applications. Those skilled in the art will appreciate that any number of variable polishing characteristics may be specified for purposes of the present invention.

In accordance with known CMP principles, one or more slurries or polishing consumables may be applied to first and second polishing elements 126, 127 to facilitate material removal and/or conditioning of the workpieces. Accordingly, polishing apparatus 100 preferably includes a first nozzle 152 for applying a first polishing composition to first polishing element 126 during processing of the workpiece. Similarly, polishing apparatus 100 may include a second nozzle 154 for applying a second polishing composition to second polishing element 127 during processing of the workpiece. It should be noted that first and second nozzles 152, 154 are depicted in schematic fashion in FIG. 3 and that a practical implementation of polishing apparatus 100 may have any number of such nozzles mounted in any number of suitable locations to facilitate adequate coverage of the polishing surfaces. Furthermore, polishing apparatus 100 preferably includes a fluid transfer system (not shown) for transporting the polishing compositions from suitable supply containers to first and second nozzles 152, 154.

The two polishing compositions may exhibit different polishing characteristics to facilitate suitable cooperation with the respective polishing elements 126, 127 and/or the specific material layer being removed or conditioned. Those skilled in the art will recognize that any number of commercially available polishing compositions may be suitable for purposes of the present invention.

As described above, first and second polishing elements 126, 127 preferably form a vertically staggered configuration upon rotatable platen 128. Rotatable platen 128 is suitably configured such that first polishing element 126 and second polishing element 127 reside at different vertical levels. In other words, the plane defined by the surface of first polishing element 126 may be vertically offset from the plane defined by the surface of second polishing element 127. Furthermore, as shown in FIG. 3, the outer edge 156 of first polishing element 126 preferably overlaps the inner edge 158 of second polishing element 127. Although the amount of overlap may vary from application to application, the preferred embodiment employs a polish pad overlap within the range of 0.5 to 1.5 inches for 8 inch wafers. The amount of overlap may depend upon the size of first and second polishing elements 126, 127, the diameter of the workpieces, the shape and size of carrier elements 124, or other physical parameters of polishing apparatus 100. As described above, first and second polishing elements 126, 127 are preferably arranged as substantially concentric rings (alternatively, first polishing element 126 may be a round disc). Consequently, the outer diameter of first polishing element 126 is preferably greater than the inner diameter of second polishing element 127. FIG. 5 depicts inner edge 158 of second polishing element 127 (in dashed lines) within outer edge 156 of first polishing element 126.

As described above, first and second polishing elements 126, 127 may be configured with different polishing characteristics and different slurry compositions may be applied to the respective polishing elements during processing. For some applications, the slurry used for first polishing element 126 should remain separate from the slurry used for second polishing element 127, i.e., slurry from one polishing element should not contaminate the other polishing element. Accordingly, the preferred embodiment may include a trough 160 located around the circumference of first polishing element 126 (see FIG. 3). Trough 160 is suitably configured to collect the polishing composition from first polishing element 126 during processing and to substantially prevent the first polishing composition from contacting second polishing element 127. Trough 160 may be configured to direct the collected slurry to a drainage location remote from second polishing element 127. It should be appreciated that trough 160 is designed to substantially reduce the exposure of second polishing element 127 to the first polishing composition; in practice, small amounts of the polishing composition may be ejected onto second polishing element 127 or may leak past trough 160.

Polishing apparatus 100 may employ any suitable structure or method for collecting the first polishing composition and/or for substantially preventing the first polishing composition from contacting second polishing element 127. For example, rotatable platen 128 and first polishing element 126 may be configured such that drainage channels (not shown) direct the first polishing composition away from second polishing element 127. Trough 160, however, provides a simple and inexpensive means for collecting the slurry used in connection with first polishing element 126.

The polishing composition used in connection with second polishing element 127 may be allowed to spill over the outer edge of second polishing element 127 for disposal or other handling. Of course, if additional polishing elements are located under second polishing element 127, then a second trough may be located around the perimeter of second polishing element 127 to facilitate collection of the second polishing composition as described above with respect to trough 160. Slurry that falls over inner edge 158 of second polishing element 127 may travel to the outer edge via a number of conduits 162 formed between a plurality of support structures 164 that may be employed by rotatable platen 128 (see FIG. 4). Support structures 164 are preferably located under second polishing element 127 in a spaced-apart arrangement. Although obscured from view in FIG. 4, a ring-shaped support platform is preferably located between polishing element 127 and the upper surfaces of support structures 164. Thus, the support platform provides a continuous surface upon which polishing element 127 may be affixed. This continuous surface facilitates application of a segmented second polishing element 127 (as shown in FIG. 4), while providing a uniformly flat surface for second polishing element 127, which may be important for the precision processing of semiconductor wafers.

An exemplary polishing process that utilizes two vertically staggered polishing elements may begin by setting the rotational speed of first polishing element 126 and the downforce of the respective carrier elements 124. Those skilled in the art will recognize that different CMP processes may require different polishing recipes and that polishing apparatus 100 may vary any number of polishing parameters in accordance with known techniques. The respective carrier elements 124 may be moved above first polishing element 126 while a first polishing composition or slurry is applied to first polishing element 126. The first polishing process is carried out when the respective carrier elements 124 hold the workpieces against first polishing element 126, which is caused to rotate.

During the first polishing process, the first slurry may be collected in trough 160, as described above. In addition, second polishing element 127 may be rinsed with deionized water (or other suitable solution) during the first polishing process to prepare it for its next use. Such rinsing techniques and related devices are well known to those skilled in the art and, therefore, will not be described in detail herein. After the first polishing process is complete, the carrier elements 124 are lifted and the associated workpieces are preferably rinsed with deionized water (or other suitable solution). Rinsing ensures that excess slurry and particulates are removed from the workpieces prior to the second polishing process.

Polishing apparatus 100 may adjust the rotational speed of second polishing element 127 and the downforce associated with carrier elements 124. In a preferred embodiment, the downforce differs between the first polishing process (which may be an aggressive removal step) and the second polishing process (which may be a fine buffing step). Next, the respective carrier elements 124 are moved from a location above first polishing element 126 to a location above second polishing element 127 and a second slurry is applied to second polishing element 127. The overlapping, vertically staggered arrangement allows carrier assembly 122 to quickly transport carrier elements 124 from first polishing element 126 to second polishing element 127 without a significant amount of horizontal travel. The second polishing process is performed when carrier elements 124 hold the workpieces against second polishing element 127, which rotates or otherwise moves relative to the workpieces.

It should be noted that any number of conventional CMP techniques may be incorporated into the polishing procedure described above. For example, first and second polishing elements 126, 127 may be conditioned prior to use or between polishing cycles. In addition, the procedure described above is merely exemplary; some of the processing steps may be performed simultaneously or in a different order than that set forth above.

The present invention has been described above with reference to a preferred embodiment. However, those skilled in the art will recognize that changes and modifications may be made to the preferred embodiment without departing from the scope of the present invention. For example, the use of multiple polishing elements and the vertically staggered arrangement may be incorporated into other elements of polishing apparatus 100, e.g., integral to index table 120. In addition, the present invention may be practiced in connection with other workpiece processing machines that include polishing, buffing, conditioning, or cleaning stations. These and other changes or modifications are intended to be included within the scope of the present invention, as expressed in the following claims.

What is claimed is:

1. A chemical mechanical planarization (CMP) system for processing a workpiece, said CMP system comprising:

a carrier element configured to hold said workpiece during processing;

a rotatable platen located proximate said carrier element;

a first polishing element mounted to said rotatable platen, said first polishing element being configured to process said workpiece when said carrier element holds said workpiece in contact with said first polishing element;

means for applying a first polishing composition to said first polishing element during processing of said workpiece;

a second polishing element mounted to said rotatable platen, said second polishing element being configured to further process said workpiece when said carrier element holds said workpiece in contact with said second polishing element, said second polishing element having different polishing characteristics than said first polishing element; and means for applying a second polishing composition to said second polishing element during processing of said workpiece, said second polishing composition having different polishing characteristics than said first polishing element; wherein movement of said rotatable platen causes simultaneous movement of said first and second polishing elements.

2. A CMP system according to claim 1, further comprising means for collecting said first polishing composition from said first polishing element during processing, said means for collecting being configured to substantially prevent said first polishing composition from contacting said second polishing element during processing.

3. A CMP system according to claim 1, wherein:

said first and second polishing elements are configured as substantially concentric rings; and said first and second polishing elements are physically separated from one another.

4. A CMP system according to claim 3, wherein the plane defined by said first polishing element is offset from the plane defined by said second polishing element.

5. A CMP system according to claim 4, wherein the outer diameter of said first polishing element is greater than the inner diameter of said second polishing element.

6. In a chemical mechanical planarization (CMP) system having a carrier element configured to hold a workpiece during processing, a method for processing said workpiece comprising the steps of:

(a) holding said workpiece against a first polishing element mounted to a rotatable platen;

(b) applying a first polishing composition to said first polishing element;

(c) processing said workpiece with said first polishing element;

(d) holding said workpiece against a second polishing element mounted to said rotatable platen, said second polishing element having different polishing characteristics than said first polishing element;

(e) applying a second polishing composition to said second polishing element, said second polishing composition having different polishing characteristics than said first polishing composition; and (f) processing said workpiece with said second polishing element.

7. A method according to claim 6, further comprising the step of rotating said rotatable platen such that said first and second polishing elements rotate in a simultaneous manner.

8. A method according to claim 6, further comprising the step of collecting said first polishing composition during said processing step (c) to substantially prevent said first polishing composition from contacting said second polishing element.

9. A method according to claim 6, wherein said method further comprises the step of moving said carrier from a location above said first polishing element to a location above said second polishing element, said moving step occurring after said processing step (c).

10. A method according to claim 6, wherein:

said first and second polishing elements are configured as substantially concentric rings; and said first and second polishing elements are physically separated from one another.

11. A method according to claim 6, wherein a first downforce associated with said holding step (a) differs from a second downforce associated with said holding step (d).

12. A method according to claim 6, further comprising the step of rinsing said second polishing element prior to said holding step (d).

13. A method according to claim 6, further comprising the step of rinsing said workpiece between said processing step (c) and said holding step (d).

14. A chemical mechanical planarization (CMP) system for processing a workpiece, said CMP system comprising:

a carrier element configured to hold said workpiece during processing;

a first polishing element configured to rotate about an axis of rotation;

means for applying a first polishing composition to said first polishing element during processing of said workpiece;

a second polishing element physically distinct from said first polishing element and configured to rotate about said axis of rotation, said second polishing element having different polishing characteristics than said first polishing element; and means for applying a second polishing composition to said second polishing element during processing of said workpiece, said second polishing composition having different polishing characteristics than said first polishing element; wherein said first polishing element is configured to perform initial processing of said workpiece when said carrier element holds said workpiece in contact with said first polishing element; and said second polishing element is configured to perform subsequent processing of said workpiece when said carrier element holds said workpiece in contact with said second polishing element.

15. A CMP system according to claim 14, wherein:

each of said first and second polishing elements is substantially ring-shaped; and said first and second polishing elements are substantially concentric.

16. A CMP system according to claim 14, further comprising a trough located around the circumference of said first polishing element, said trough being configured to collect said first polishing composition from said first polishing element during processing and to substantially prevent said first polishing composition from contacting said second polishing element during processing.

17. A CMP system according to claim 14, wherein the plane defined by said first polishing element is offset from the plane defined by said second polishing element.

18. A CMP system according to claim 17, wherein the outer diameter of said first polishing element is greater than the inner diameter of said second polishing element.

19. A CMP system according to claim 14, wherein said first and second polishing elements are mounted on a single rotatable platen.

20. A CMP system according to claim 14, wherein said first and second polishing elements are capable of rotating at different speeds.

21. A chemical mechanical planarization (CMP) system for processing workpieces, said CMP system comprising:

a first polishing element having a first polishing plane defined thereby and having an outer edge;

a second polishing element having a second polishing plane defined thereby and having an inner edge, said first polishing plane being vertically offset from said second polishing plane; and a first carrier element configured to hold a first workpiece in contact with either of said first and second polishing elements; wherein said outer edge of said first polishing element and said inner edge of said second polishing element overlap such that said first and second polishing elements form a vertically staggered arrangement.

22. A CMP system according to claim 21, wherein said first and second polishing elements are configured as substantially concentric rings.

23. A CMP system according to claim 22, wherein the outer diameter of said first polishing element is greater than the inner diameter of said second polishing element.

24. A CMP system according to claim 21, wherein said first and second polishing elements rotate about a common axis of rotation.

25. A CMP system according to claim 21, wherein said second polishing element has different polishing characteristics than said first polishing element.

26. A CMP system according to claim 21, wherein said first and second polishing elements are coupled to a single rotatable platen.

27. A CMP system according to claim 21, further comprising a second carrier element configured to hold a second workpiece in contact with either of said first and second polishing elements, wherein said first and second carrier elements are capable of performing simultaneous polishing of said first and second workpieces on said first and second polishing elements.

28. A CMP system according to claim 21, wherein said first and second polishing elements are capable of independent motion relative to each other.

29. In a chemical mechanical planarization (CMP) system having a carrier element configured to hold a workpiece during processing, a method for processing said workpiece comprising the steps of:

(a) holding said workpiece against a first polishing element mounted to a rotatable platen;

(b) processing said workpiece with said first polishing element;

(c) holding said workpiece against a second polishing element mounted to said rotatable platen, said second polishing element having different polishing characteristics than said first polishing element; and (d) processing said workpiece with said second polishing element; wherein (e) a first downforce associated with said holding step (a) differs from a second downforce associated with said holding step (c).

30. In a chemical mechanical planarization (CMP) system having a carrier element configured to hold a workpiece during processing, a method for processing said workpiece comprising the steps of:

(a) holding said workpiece against a first polishing element mounted to a rotatable platen;

(b) processing said workpiece with said first polishing element;

(c) rinsing a second polishing element mounted to said rotatable platen, said second polishing element having different polishing characteristics than said first polishing element;

(d) subsequently holding said workpiece against said second polishing element; and (e) processing said workpiece with said second polishing element.

31. In a chemical mechanical planarization (CMP) system having a carrier element configured to hold a workpiece during processing, a method for processing said workpiece comprising the steps of:

(a) holding said workpiece against a first polishing element mounted to a rotatable platen;

(b) processing said workpiece with said first polishing element;

(c) rinsing said workpiece after said processing step (b);

(d) subsequently holding said workpiece against a second polishing element mounted to said rotatable platen, said second polishing element having different polishing characteristics than said first polishing element; and (e) processing said workpiece with said second polishing element.

32. A chemical mechanical planarization (CMP) system for processing a workpiece, said CMP system comprising:

a carrier element configured to hold said workpiece during processing;

a first polishing element configured to rotate about an axis of rotation; and a second polishing element physically distinct from said first polishing element and configured to rotate about said axis of rotation, said second polishing element having different polishing characteristics than said first polishing element; wherein the plane defined by said first polishing element is offset from the plane defined by said second polishing element;

said first polishing element is configured to perform initial processing of said workpiece when said carrier element holds said workpiece in contact with said first polishing element; and said second polishing element is configured to perform subsequent processing of said workpiece when said carrier element holds said workpiece in contact with said second polishing element.

33. A CMP system according to claim 32, wherein the outer diameter of said first polishing element is greater than the inner diameter of said second polishing element.

* * * * *